US009923255B2

(12) United States Patent
Carignan et al.

(10) Patent No.: US 9,923,255 B2
(45) Date of Patent: Mar. 20, 2018

(54) CROSS-GUIDE COUPLER WITH MAIN WAVEGUIDE ARM AND SUBSTRATE INTEGRATED WAVEGUIDE (SIW) SECONDARY ARM

(71) Applicant: APOLLO MICROWAVES, LTD, Dorval (CA)

(72) Inventors: Louis-Philippe Carignan, Pincourt (CA); Dominic Gagne, Vaudreuil-Dorion (CA)

(73) Assignee: Apollo Microwaves LTD., Dorval (CA)

( * ) Notice: Subject to any disclaimer, the term of this patent is extended or adjusted under 35 U.S.C. 154(b) by 113 days.

(21) Appl. No.: 14/935,323

(22) Filed: Nov. 6, 2015

(65) Prior Publication Data

US 2017/0133737 A1 May 11, 2017

(51) Int. Cl.

| | |
|---|---|
| ***H01P 5/12*** | (2006.01) |
| ***H01P 3/12*** | (2006.01) |
| ***H01P 5/02*** | (2006.01) |
| ***H01P 5/18*** | (2006.01) |

(52) U.S. Cl.
CPC ..... *H01P 3/121* (2013.01); *H01P 5/024* (2013.01); *H01P 5/181* (2013.01)

(58) Field of Classification Search
CPC ..... H01R 23/00; H01P 3/121; H01P 5/19
USPC ..... 333/137
See application file for complete search history.

(56) References Cited

U.S. PATENT DOCUMENTS

| | | | | |
|---|---|---|---|---|
| 3,377,571 A * | 4/1968 | Kinsey | H01P 5/181 333/114 |
| 6,580,335 B1 | 6/2003 | Iizuka et al. | |
| 8,669,834 B2 * | 3/2014 | Cheng | H01P 3/121 29/600 |

FOREIGN PATENT DOCUMENTS

| | | | |
|---|---|---|---|
| WO | 2011/157022 A1 | 12/2011 | |
| WO | 2014154232 | 10/2014 | |
| WO | WO 2014154231 A1 * | 10/2014 | H01Q 13/18 |

OTHER PUBLICATIONS

Rao et al. "Analysis of Small Aperture Coupling Between Rectangular Waveguide and Microstrip Line" IEEE Transactions on Microwaves Theory and Techniques, vol. MTT-29, No. 2, Feb. 1981, p. 150-154.
Kaneda et al. "A Broadband Microstrip-to-Waveguide Transition Using Quasi-Yagi Antenna" 1999 IEEE, p. 1-4.
Kumar "Coupled Transmission Lines" IEEE Transactions on Microwave Theory and Techniques, vol. MTT-25, No. 1, Jan. 1977, p. 7-10.
Lu et al. "Design of High Power Waveguide to Microstrip Directional Coupler" 2012 5th Global Symposium on Millimeter Waves (GSMM 2012), p. 299-302.

(Continued)

*Primary Examiner* — Robert J Pascal
*Assistant Examiner* — Kimberly Glenn
(74) *Attorney, Agent, or Firm* — Wolf, Greenfield & Sacks, P.C.

(57) ABSTRACT

A cross-guide coupler for use in a waveguide network is provided. The cross-guide coupler comprises a main waveguide arm having an input port and a transmitted port and a hollow metallic conduit therebetween. The cross-guide coupler also comprises a secondary arm positioned substantially transversely relative to the main arm and being fastened to the main arm, wherein the secondary arm includes a substrate integrated waveguide.

35 Claims, 13 Drawing Sheets

(56) References Cited

OTHER PUBLICATIONS

Aliakbarian et al. "Novel Low-Cost End-Wall Microstrip-To-Waveguide Splitter Transition" Progress in Electromagnetics Research, PIER 101, 75-96, 2010, p. 75-96.
Grabherr et al. "Microstrip to Waveguide Transition Compatible With MM-Wave Integrated Circuits" IEEE Transactions on Microwaves Theory and Techniques, vol. 42, No. 9, Sep. 1994, p. 1842-1843.
Iizuka et al. "Millimeter-Wave Microstrip Line to Waveguide Transition Fabricated on a Single Layer Dielectric Substrate" R&D Review of Toyota CRDL vol. 37, No. 2, p. 13-18.
Prasad et al. "Waveguide to Microstrip Multi-Aperture Directional Coupler" Department of Electrical Engineering, Indian Institute of Technology, p. 425-429.
Examiner's Report issued on Oct. 11, 2016 in connection with Canadian Application No. 2,911,694, 2 pages.
J.A.R et al., "Crossed Waveguide Directional Couplers for High Power Applications", Journel of Microwave Power and Electromagnetic Energy, vol. 35, No. 4, pp. 232-241, 2000.

* cited by examiner

CROSS-GUIDE COUPLER WITH MAIN WAVEGUIDE ARM AND SUBSTRATE INTEGRATED WAVEGUIDE (SIW) SECONDARY ARM

FIELD OF THE INVENTION

The present invention relates to the field of passive microwave components and, more specifically, to a cross-guide coupler configured to couple radio frequency (RF) waves transmitted in a waveguide to a substrate integrated waveguide (SIW).

BACKGROUND

Cross-guide couplers are known in the art for handling RF waves. Typically, cross-guide couplers are used for measuring and monitoring RF signals propagating through a waveguide arrangement and/or for combining multiple RF signals. For example, a common use for waveguide couplers is to sample a signal within a waveguide network in order to monitor the operation of a circuit, which may for example allow detecting potential malfunctions in the circuit. Another common use of waveguide couplers is to allow injecting an additional signal into a waveguide network.

An example of a typical cross-guide waveguide coupler 200 is shown at FIG. 1. As shown, the waveguide coupler 200 comprises a main waveguide arm 202 and a secondary waveguide arm 204 transversely positioned relative to the main arm 202 and fastened thereto in a suitable manner (e.g., via welding). Each of the main arm 202 and the secondary arm 204 consists of a hollow metallic conduit within which RF energy propagates. The main arm 202 comprises first and second waveguide ports 206, 208 while the secondary arm 204 comprises third and fourth waveguide ports 210, 212. For the purpose of this example, the first port 206 is an "input port" and the second port 208 is an "output port" or a "transmitted port" such that RF energy inputted at the first port 206 propagates through the main arm 202 towards the second port 208. In order to couple RF energy from the main arm 202 to the secondary arm 204, a coupling element comprised of one or more apertures (not shown) is provided in the adjacent walls of the main arm 202 and secondary arm 204. In a specific practical example, the apertures may allow a portion of the RF energy propagating through the main arm 202 from the first port 206 the second port 208 to be diverted and transmitted to the third port 210 which may be referred to as a "coupled port". In such example, the fourth port 212 of the secondary arm 204 is typically used as an "isolated port" and is terminated by coupling it to a matched load (not shown). The third port 210 is typically connected to a detection circuit (not shown) configured to measure/monitor the RF energy released at the third port 210. The transmission of the RF energy within the coupler 200 is conceptually illustrated in FIG. 2.

FIG. 3 illustrates an example of a coupling element including an aperture 214 that may be used to couple RF energy from the main arm 202 to the secondary arm 204. In this specific example, the aperture 214 is cross-shaped such that it comprises a generally vertical slot and a generally horizontal slot positioned so that the two slots intersect one another substantially at the mid-point of each slot. On the main waveguide arm 202, the aperture 214 is positioned such that its horizontal slot is generally transversal to a longitudinal extent of the main 202 while the vertical slot is generally aligned with the longitudinal extent of the main arm 202. The shape and dimensions of the aperture 214 affect the coupling of the RF signal from the main arm 202 to the secondary arm 204. For additional informal pertaining to typical cross-guide waveguide couplers of the type described, the reader is invited to refer to J. A. R. Ball and T. M. Sulda, "*Crossed Waveguide Directional Couplers for High Power Applications*", J. Microw. Power Electromagnetic Energy, vol. 35, no. 4, pp. 232-241, the contents of which are incorporated herein by reference.

FIGS. 4A to 4D illustrate a RF magnetic field of the RF wave near the cross-shaped aperture 214 at times t=0, t=T/4, t=T/2 and t=3T/4 respectively, where T is the time for one guided wavelength period. As shown, at t=0, the magnetic field is oriented downwards (i.e., in a direction transversal to a longitudinal extent of the main arm 202) such that the coupling to the secondary arm 204 of the coupler 200 is mostly done via the vertical slot of the cross-shaped aperture 214. At t=T/4, the magnetic field is oriented horizontally (i.e., in a direction parallel to the longitudinal extent of the main arm 202) such that the coupling to the secondary arm 204 of the coupler 200 is mostly done via the horizontal slot of the cross-shaped aperture 214. It will be appreciated that the magnetic field in FIGS. 4A to 4D rotates in a counter-clockwise direction. This rotation of the magnetic field is the same in the secondary arm 204 of the coupler 200 and determines the transmission direction of the RF signal within the secondary arm 204. The magnetic field therefore plays a significant role in the quality of the coupling between the main arm 202 and the secondary arm 204.

Traditional waveguide couplers of the type depicted in FIG. 1 tend to be bulky in view of the relatively large cross-section of each of the main arm 202 and the secondary arm 204, which for some practical applications may be undesirable.

In light of the above, there is a need in the industry for an improved cross-guide coupler that alleviates, at least in part, the deficiencies with existing couplers.

SUMMARY

In accordance with a first aspect, a cross-guide coupler for use in a waveguide network is provided. The coupler comprises a main waveguide arm comprising an input port and a transmitted port, the main waveguide arm including a hollow metallic conduit. The coupler also comprises a secondary arm positioned substantially transversely relative to the main arm and being fastened to the main arm, wherein the secondary arm includes a substrate integrated waveguide.

In some specific implementations, the hollow metallic conduit may have a generally rectangular cross-section defined by a top wall, a bottom wall, and opposite lateral walls. The secondary arm may be fastened to the main arm along at least a portion of an outer surface of the top wall. The main arm may include a coupling aperture formed on the top wall for coupling at least part of energy travelling through the main waveguide arm into the secondary arm.

In some specific implementations, the substrate integrated waveguide may include a dielectric substrate and top and bottom metallic layers between which the dielectric substrate is sandwiched. An aperture may be formed on the bottom metallic layer of the substrate integrated waveguide and may be positioned so as to be substantially aligned with the coupling aperture formed on the top wall of the main waveguide arm. In some alternate embodiments, the bottom metallic layer may be omitted and the dielectric substrate may be sandwiched between the top metallic layer and the outer surface of the top wall of the main waveguide arm.

In some specific implementations, a plurality of via holes may be formed within the substrate integrated waveguide, the plurality of via holes being arranged in two rows spaced apart laterally along sides of the substrate integrated waveguide. Alternatively, a pair of elongated channels may be formed within the substrate integrated waveguide, channels of the pair of elongated channels being spaced apart laterally along sides of the substrate integrated waveguide.

In some implementations, the secondary arm may include the substrate integrated waveguide and a cover member shielding the substrate integrated waveguide. The cover member may include one or more contact elements to capture a signal travelling through the substrate integrated waveguide, the one or more contact element being configured for establishing an electrical connection between the substrate integrated waveguide and an external computing device.

In accordance with a second aspect, a waveguide circuit having monitoring capabilities is provided. The waveguide circuit comprises a cross-guide coupler of the type described above and waveguide circuit components coupled to the main waveguide arm of the cross-guide coupler. The waveguide circuit also comprises an electronic monitoring device connected to the secondary arm for receiving an electrical signal representative of an RF signal propagating through the main waveguide arm of the cross-guide coupler.

In some implementations, the waveguide circuit components coupled to the main waveguide arm of the cross-guide coupler may include at least one of a circulator, a tuner and a filter, although other waveguide components may also be present in the circuit.

In some implementations, electronic monitoring device may be programmed for processing the electrical signal to derive characteristics of the RF signal propagating through the main waveguide arm of the cross-guide coupler. The derived characteristics of the RF signal may convey frequency, amplitude and wavelength information associated with the RF signal propagating through the main waveguide arm. The electronic monitoring device may be programmed for storing the derived characteristics of the RF signal on a non-transient computer readable storage medium and/or for visually conveying the derived characteristics of the RF signal on a display in communication with the electronic monitoring device.

In some implementations, the electronic monitoring device may be programmed for detecting a potential malfunction associated with the waveguide circuit components coupled to the main waveguide arm at least in part by processing the derived characteristics of the RF signal propagating through the main waveguide arm of the cross-guide coupler. The electronic monitoring device may also be programmed for issuing a notification message (e.g. an e-mail message, an SMS message and a pop-up window on a computer display device and the like) following detection of the potential malfunction associated with the waveguide circuit components coupled to the main waveguide arm. Optionally, electronic monitoring device may also be programmed for issuing control signal for deactivating at least some portions of (or the entirety of) the waveguide circuit following detection of the potential malfunction to reduce the chance of damage being caused by the potential malfunction.

All features of embodiments which are described in this disclosure and are not mutually exclusive can be combined with one another. Elements of one embodiment can be utilized in the other embodiments without further mention.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

A detailed description of specific embodiments of the present invention is provided herein below with reference to the accompanying drawings in which.

Figure 1:
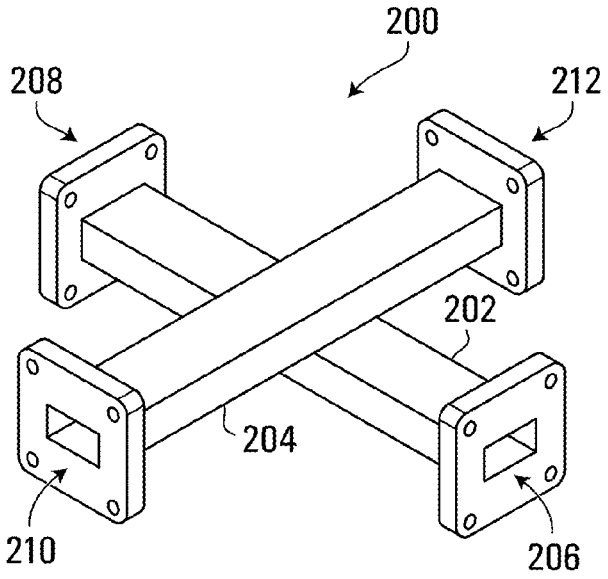
FIG. 1 (Prior Art)
FIG. 1 is a perspective view of a cross-guide waveguide coupler including a main waveguide arm and a secondary waveguide arm in accordance with a typical configuration.
Figure 2:
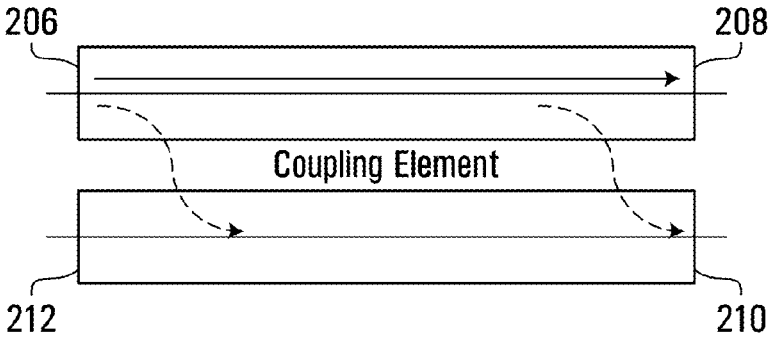
FIG. 2 (Prior Art)
FIG. 2 is a conceptual diagram showing a transmission of RF energy from the main waveguide arm to the secondary waveguide arm within the cross-guide waveguide coupler of FIG. 1.
Figure 3:
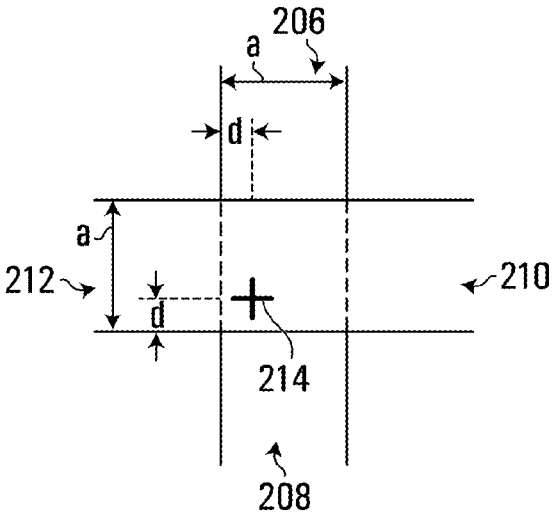
FIG. 3 (Prior Art)
FIG. 3 is a diagram showing a coupling element including an aperture between the main waveguide arm and the secondary waveguide arm of the cross-guide waveguide coupler of FIG. 1.
Figure 4A:
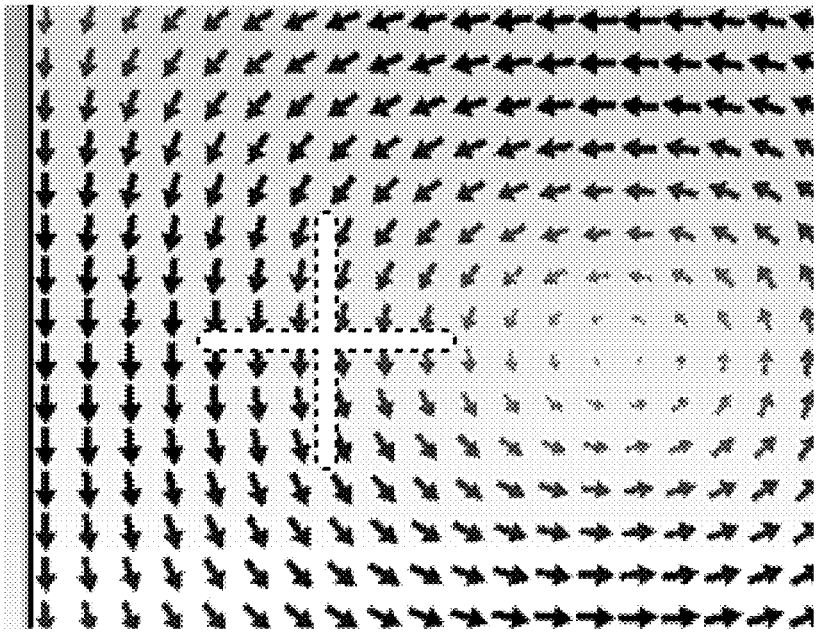
FIGS. 4A to 4D show a magnetic field of the RF signal near the coupling aperture of the coupler of FIG. 1 at times t=0, t=T/4, t=T/2 and t=3T/4 respectively, where T is the time for one guided wavelength period of the RF signal.
Figure 4B:
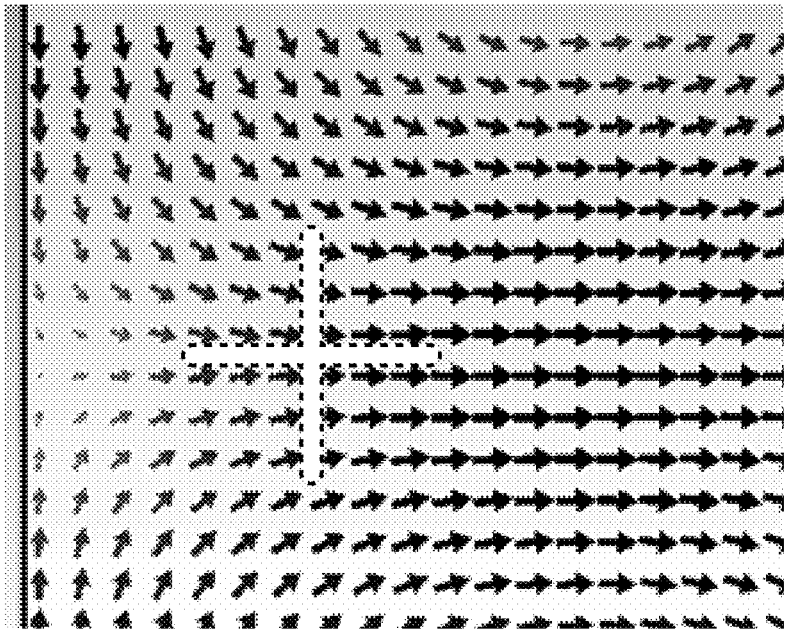
Figure 4C:
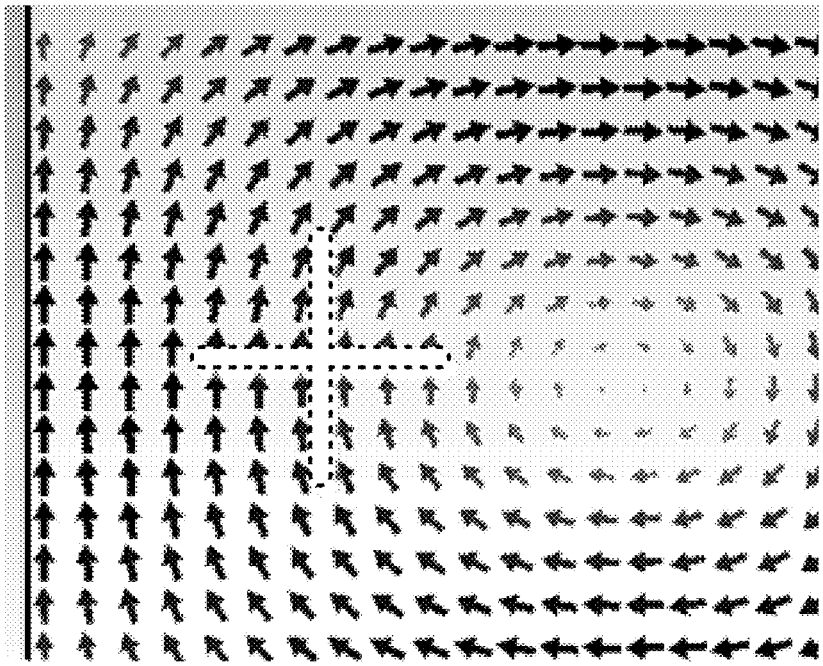
Figure 4D:
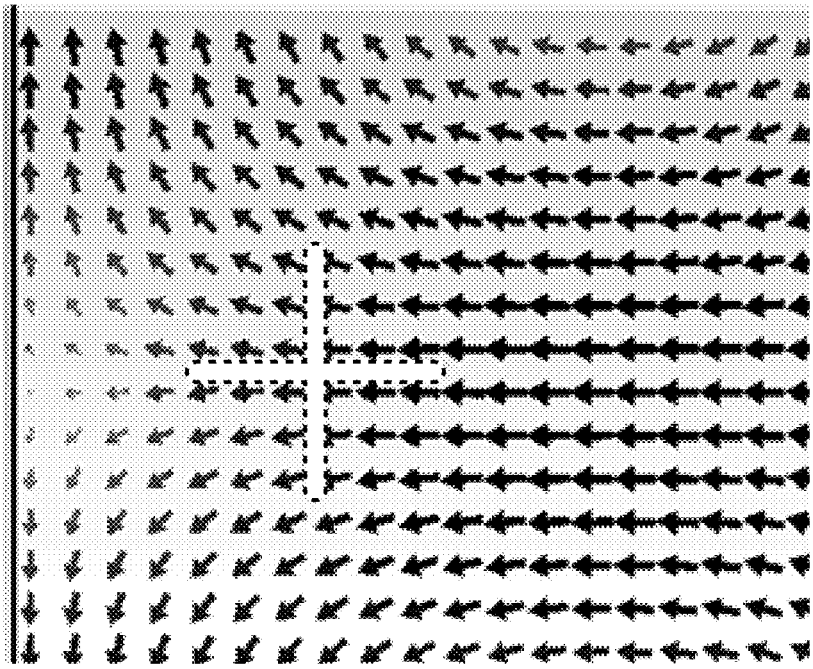

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION

Specific examples of cross-guide couplers will now be described to illustrate the manner in which the principles of the invention may be put into practice. Such cross-guide couplers may have particular utility in satellite communications equipment encompassing both ground and space segments, as well as in the radar and medical fields.

Figure 5:
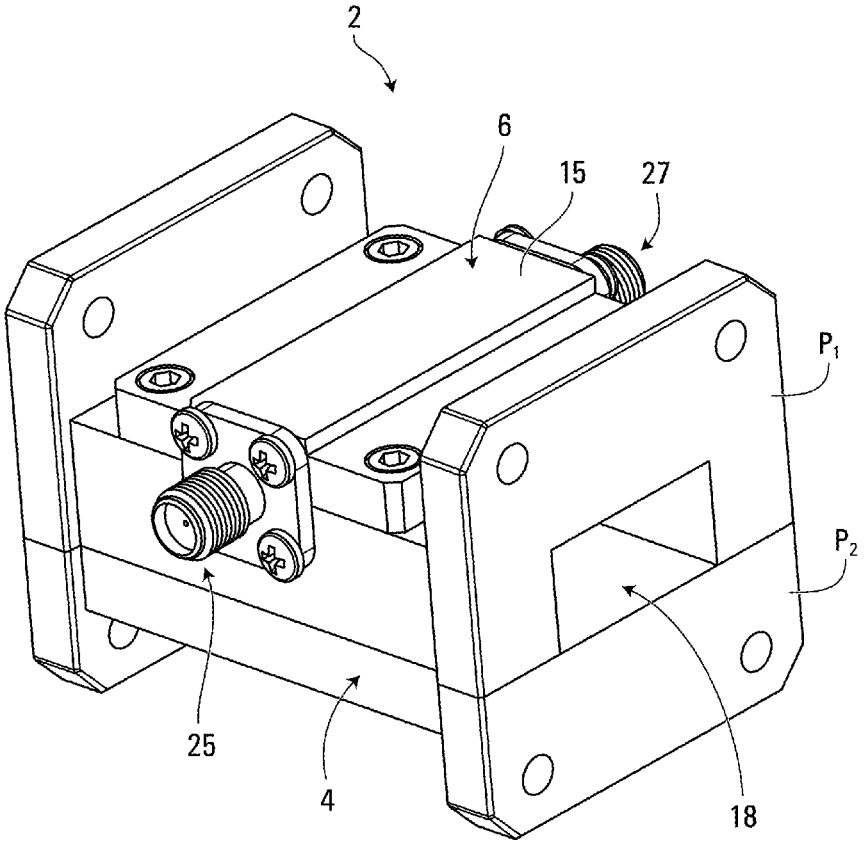
FIG. 5 is a perspective view of a cross-guide coupler having a main waveguide arm and a secondary arm comprised of a substrate integrated waveguide (SIW) element in accordance with a non-limiting example of implementation of the present invention.
Figure 6:
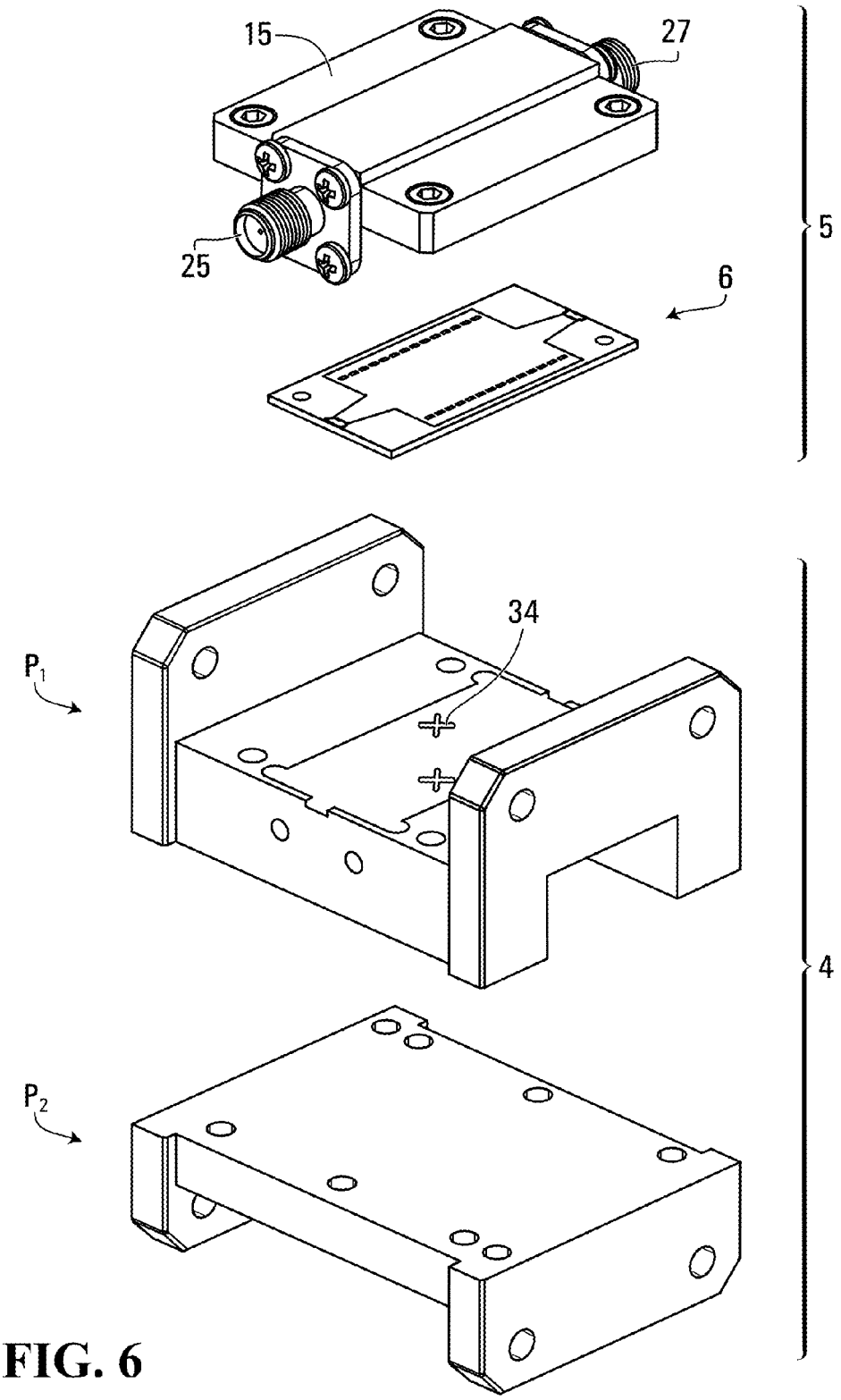
FIG. 6 is an exploded view of the cross-guide coupler shown in FIG. 5 showing separately a lower portion of the main waveguide arm, an upper portion of the main waveguide arm and the secondary arm.

Shown in FIG. 5 is a cross-guide coupler 2 in accordance with a non-limiting example of implementation. An exploded view of the cross-guide coupler 2 is shown in FIG. 6 in order to allow the reader to better understand the different components/elements that may be present in this device. As will be described in more detail below, the cross-guide coupler 2 is configured to transmit at least a portion of radio frequency (RF) energy propagating through "air" in a waveguide to a substrate integrated waveguide (SIW).

As shown, the cross-guide coupler 2 comprises a main arm 4 and a secondary arm 5 transversely positioned relative to the main arm 4 and fastened thereto.

Figure 7:
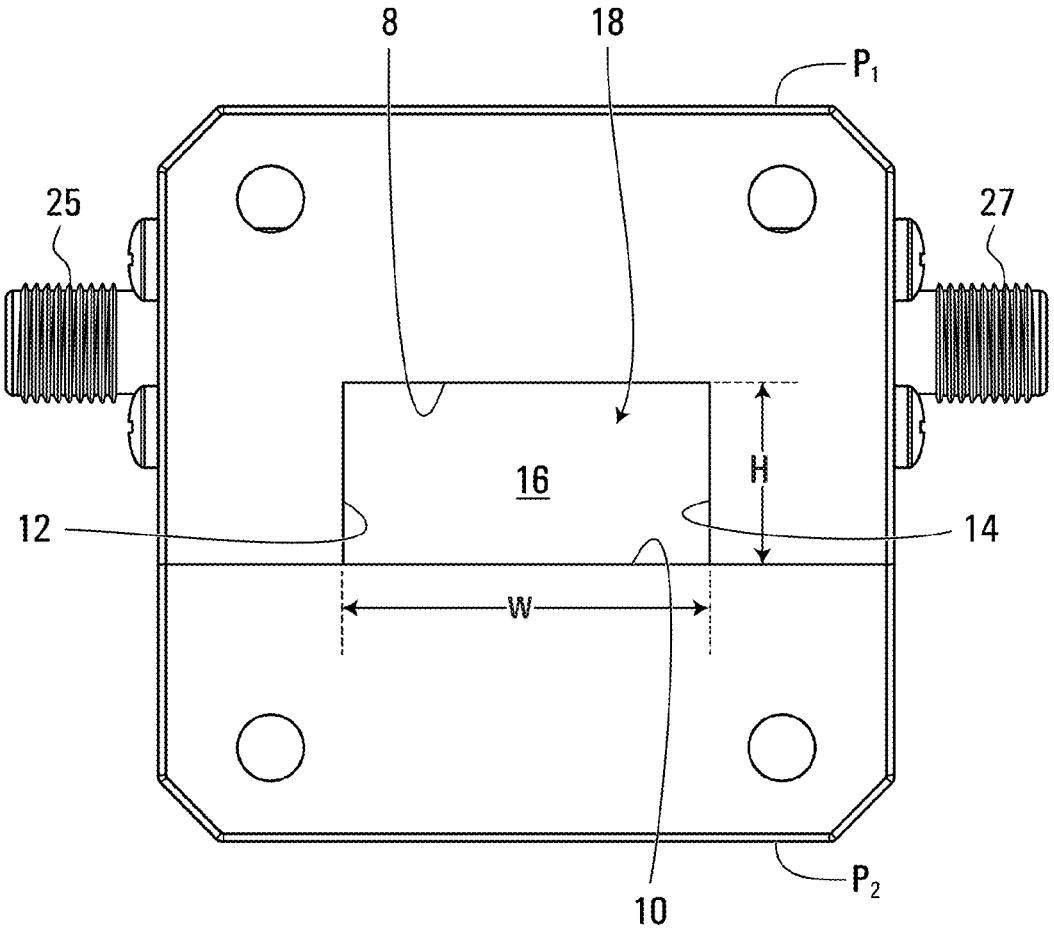
FIG. 7 is an elevation view of the cross-guide coupler of FIG. 5 with a view into a first port of the main waveguide arm.

The main arm 4 is comprised of a hollow metallic conduit having a generally rectangular cross-section. As shown in FIG. 7, the main arm 4 is defined by a top wall 8, a bottom wall 10, and opposite lateral walls 12 14. As the person skilled in the art will appreciate, the specific dimensions of the height H (measured between its top and bottom walls 8, 10) and the width W (measured between its lateral walls 12, 14) of the main arm 4 in specific practical implementations will be dependent upon the frequency of signal the cross-guide coupler 2 is intended to be used for.

Contained between the walls of the main arm 4 is a hollow interior 16 within which RF energy propagates. In view of this hollow interior 16, the main arm 4 may also be referred to as an "air filled" or "gas-filled" waveguide. The main arm 4 comprises a first port 18 and a second port 20 located at either end of the metallic conduit. RF energy entering the first port 18, which may be described as an "input port", is transmitted to the second port 20 which may be described as an "output port" or "transmitted port". In specific non-limiting examples, the first and second ports 18, 20 of the main arm 4 may be connected to other waveguide components a circulator, a tuner, a filter etc.). In the specific example depicted, the first port 18 and the second port 20 each comprise a flange for facilitating attaching the cross-guide coupler 2 to other components of a waveguide circuit. In the non-limiting example depicted, the flanges include a set of machined holes for accommodating fasteners therethrough.

In order to couple the main arm 4 to the SIW element 6 such as to enable RF energy transmission from the main arm 4 to the SIW element 6, in this embodiment, the main arm 4 comprises apertures 34 in its top wall 8. The apertures 34 may be referred to as "coupling apertures" since they couple the RF signal from the main arm 4 to the SIW element 6. In this embodiment, the apertures 34 include a pair of apertures, which are each cross-shaped such that each aperture 34 is formed by a pair of slots generally perpendicular to one another. The apertures 34 may be configured differently in other embodiments. For example, in some embodiments, the apertures 34 may be circular, rectangular, rounded rectangular, rosette-shaped, dumbbell-shaped or H-shaped. The apertures 34 may have any other suitable shape in other embodiments. Moreover, in some embodiments, the top wall 8 of the main arm 4 may comprise a single coupling aperture rather than a pair of coupling apertures or, alternatively still, the main arm may include multiple pairs of coupling apertures.

The cross-shaped apertures 34 may be positioned differently in various embodiments. For instance, in this non-limiting embodiment, the cross-shaped apertures 34 are shown as being positioned such that each one of the pair of slots of the apertures 34 defines an angle of about 45° with respect to the lateral walls 12, 14 of the main arm 4. From a machining standpoint, this may be helpful in reducing the likelihood of a tip of the cross-shaped apertures 34 reaching one of the lateral walls 12, 14 of the main arm 4. In some embodiments, the cross-shaped apertures 34 may be aligned with respect to the lateral walls 12, 14 of the main arm 4. More specifically, the cross-shaped apertures 34 may be positioned such that a given one of the pair of slots of each aperture 34 is generally parallel to the lateral walls 12, 14 of the main arm 4.

As will be explained further below, the apertures 34 have an associated magnetic polarizability $\alpha_m$ and electric polarizability $\alpha_e$, the values of which are dependent on the shape and dimensions of the apertures 34.

The Secondary Arm 5

The secondary arm 5, elements of which may be better understood with reference to the exploded view of the cross-guide coupler 2 shown in FIG. 6, is comprised of a substrate integrated waveguide (SIW) element 6 and of a cap (or cover) member 15.

In this embodiment, the cap (or cover) 15 may serve the dual purpose of (1) shielding the SIW element 6 from environmental conditions and (2) providing contact elements 25 and 27 for allowing capturing and propagating a signal travelling through the SIW element. The cover 15 may be fastened to an exterior of the main arm 4 using any suitable fasteners. In the specific embodiment depicted in the figures, the cover 15 may be fastened to the exterior of the main arm 4 using suitable fastenings screws.

Figure 10:
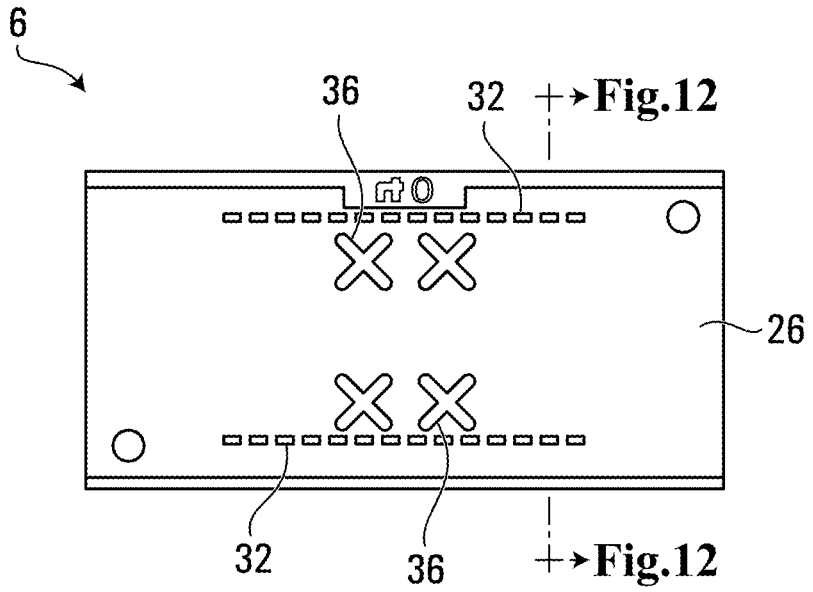
FIG. 10 is a bottom view of the SIW element shown in FIG. 9B.
Figure 11:
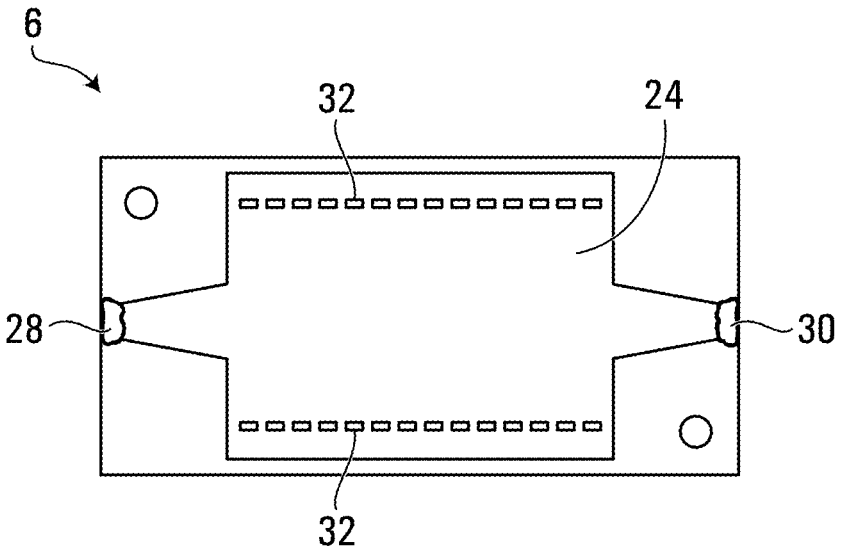
FIG. 11 is a top view of the SIW element of FIG. 9B.
Figure 12:
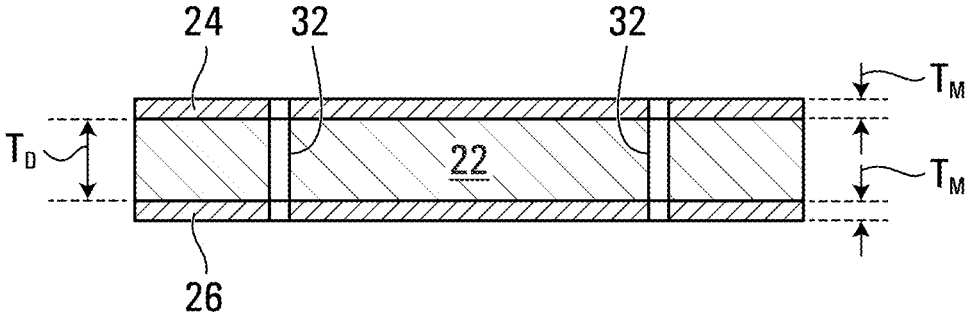
FIG. 12 is a cross-sectional view of the SIW element of FIG. 9B taken along line 12-12 shown in FIG. 10.

An example of the SIW element 6 according to a first specific embodiment of the invention is shown in greater detail in FIGS. 10 through 12.

As shown, the SIW element 6 comprises a dielectric substrate 22 and top and bottom metallic layers 24, 26 between which the dielectric substrate 22 is sandwiched. The metallic layers 24, 26 may be comprised of any suitable metal or alloy including, without being limited to, copper and/or aluminum and/or gold and/or silver. The metallic layers 24, 26 may be placed on the substrate 22 via metal deposition, lamination techniques, electroplating or any other suitable method known in the art. The substrate 22 of the SIW element 6 comprises a dielectric material having a permittivity $\in_r$ and a thickness $T_D$. In this embodiment, the dielectric material of the substrate 22 may be comprised of polymer or composite material, alumina, quartz, Teflon™, rexolite, paper, polystyrene or any other suitable solid dielectric material. In specific practical implementations, the permittivity $\in_r$ of the substrate 22 may be between 2 and 10 and its thickness $T_D$ may be between 0.03 and 0.07 inches. In specific practical implementations, each of the top and bottom metallic layers 24, 26 of the SIW element 6 may have a thickness $T_M$ of approximately 0.032 inches.

Figure 13:
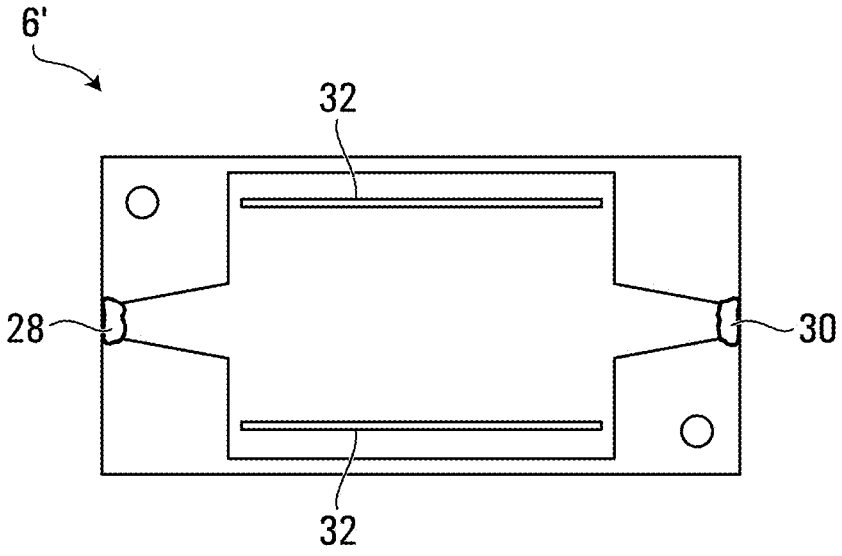
FIG. 13 is a top view of an SIW element suitable for use in connection with the secondary arm of the coupler depicted in FIG. 5 in accordance with an alternative embodiment.

The SIW element 6 further comprises a plurality of via holes 32 configured to create lateral boundaries to contain RF signals travelling within the SIW element 6. To that end, the plurality of via holes 32 are arranged in two rows spaced apart laterally and the interior surface of each via hole 32 is plated by a metallic layer. As a result, RF energy travelling within the SIW element 6 may be bounded by the top and bottom metallic layers 24, 26 and laterally by the plurality of holes 32. In this embodiment, the via holes 32 are shown as being substantially rectangular in shape. In some alternate embodiments, the via holes 32 may be circular or have any other suitable shape. In other embodiments, for example as shown in FIG. 13, the via holes 32 may be replaced by a pair of elongated channels wherein the interior surface of each is plated by a metallic layer inner.

The SIW element 6 comprises third and fourth ports 28, 30 at its longitudinal ends. As will be further described below, a portion of the RF energy travelling through the main arm 4 of the cross-guide coupler 2 is transmitted to the SIW element 6. More specifically, the RF signal transmitted to the SIW element 6 is outputted at the third port 28 which may be described as a "coupled port". The fourth port 30 of the SIW element 6 is typically an "isolated port" in that RF energy outputted through the fourth port 30 is transmitted to a termination device (not shown), typically a matched load. Such termination devices are known and will therefore not be further described here.

In order to enable the RF energy propagated in the main arm 4 to be coupled to the SIW element 6, on its lower surface the SIW element 6 may further comprise apertures 36 corresponding to the apertures 34 in the main arm 4. More specifically, the SIW element 6 comprises apertures 36 in its bottom metal layer 26 to allow coupling the SIW element 6 with the apertures formed on the main arm 4. For instance, in this embodiment, the apertures 36 are cross-shaped to match the shape of apertures 34 in the main arm 4. The apertures 36 may be formed by omitting from a certain area the metallic layer, using lithography for example, in order to allow RF energy to propagate into the dielectric substrate 22 of the SIW element 6. The apertures 36 may thus allow a portion of the RF energy transmitted in the main arm 4 to be coupled to the SIW element 6.

Figure 8:
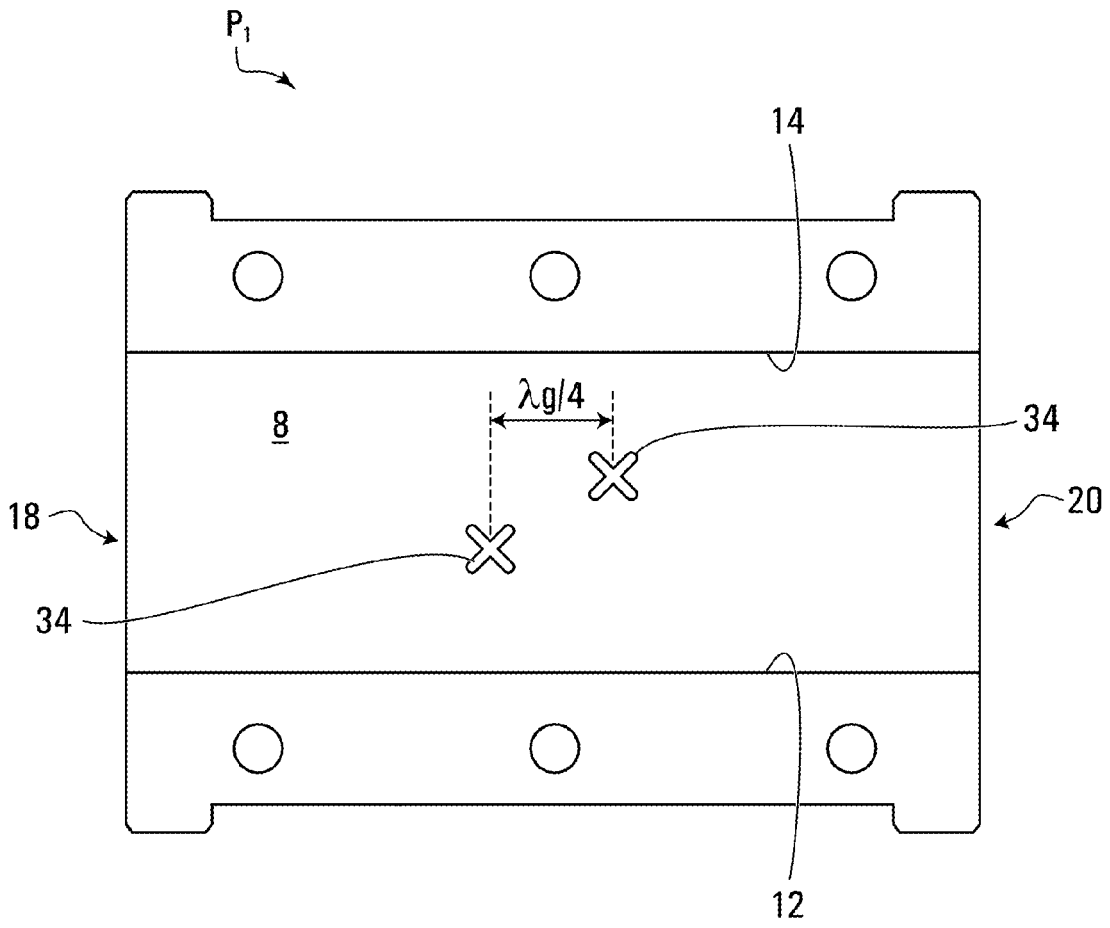
FIG. 8 is a bottom view of the upper portion of the main waveguide arm of the coupler shown in FIG. 5 with the lower portion of the main waveguide arm removed to show coupling apertures formed on the upper portion of the main waveguide arm in accordance with a specific example of implementation.
Figure 9A:
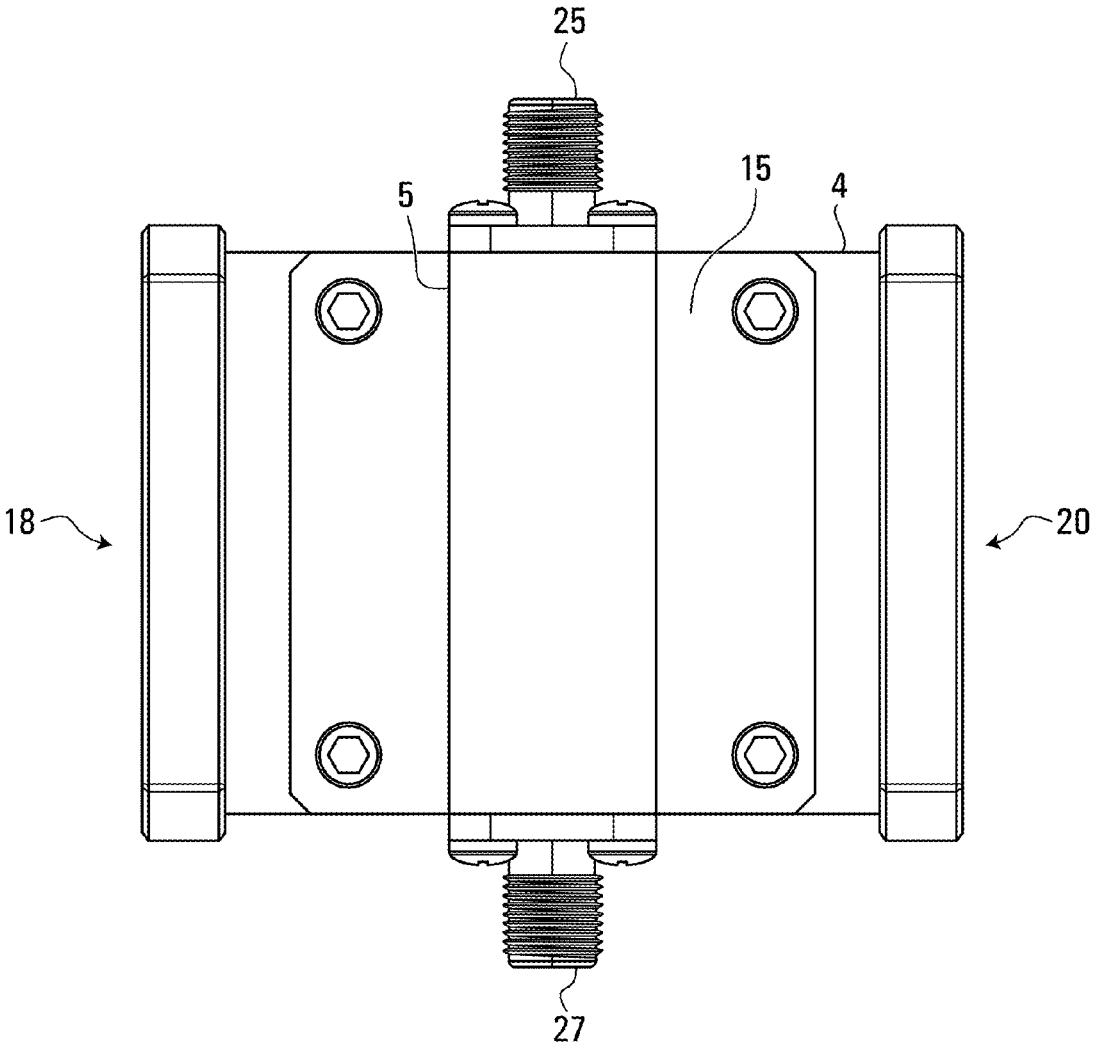
FIG. 9A is a top view of the cross-guide coupler shown in FIG. 5 showing the top of the secondary arm.
Figure 9B:
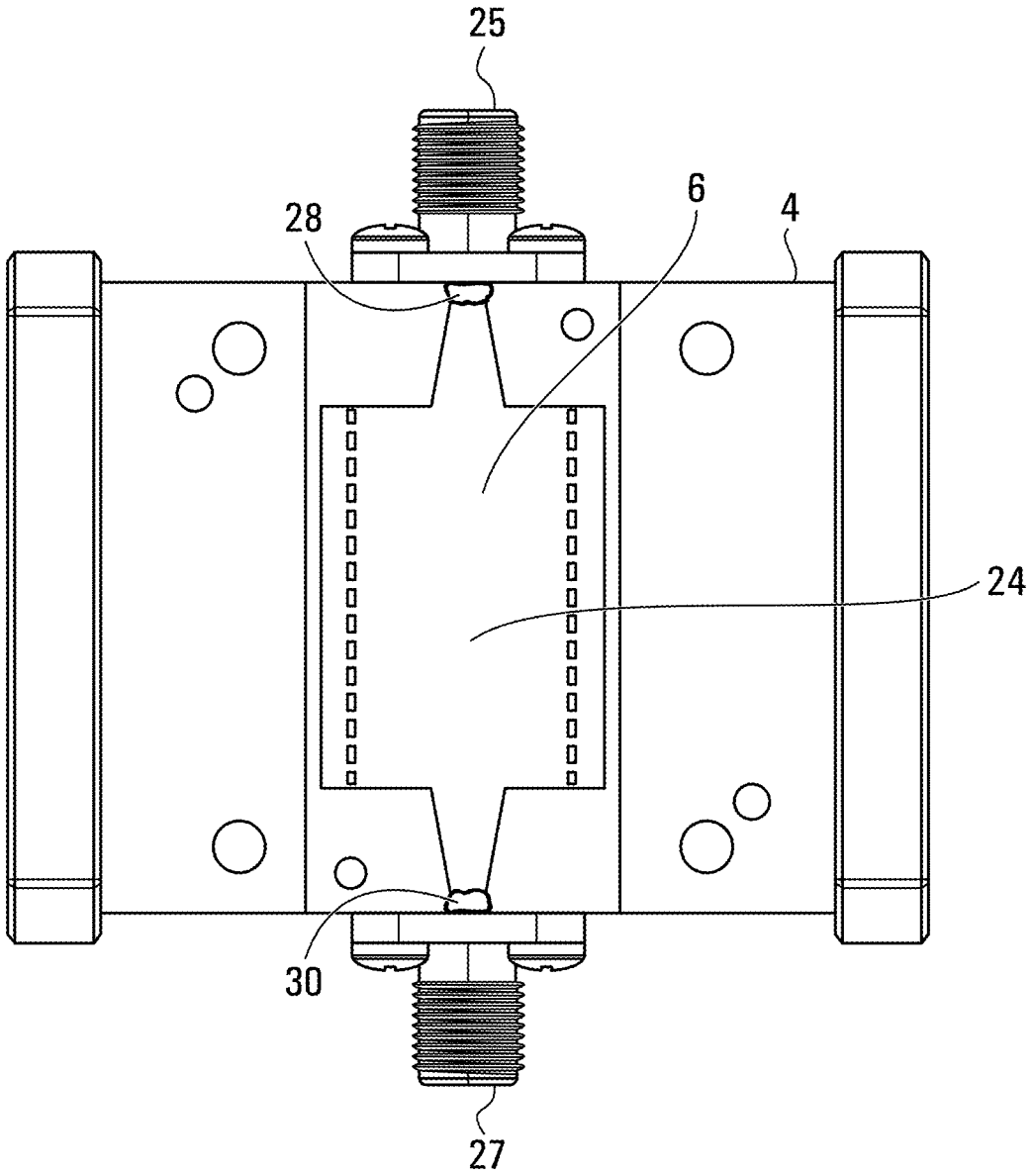
FIG. 9B is a top view of the cross-guide coupler of FIG. 5 with a cover of the secondary arm having been removed to reveal the substrate integrated waveguide (SIW) element in accordance with a specific example of implementation.

In the embodiment depicted, the SIW element 6 is shown as comprising two pairs of apertures 36*a* 36*b*. When positioned on top of the main arm 4, one of the two pairs of apertures 36*a* 36*b* on the SIW element 6 creates a coupling with the pair of apertures 34 formed on the main arm 4 to allow for the coupling of RF energy between the main arm 4 and the SIW element 6. The person skilled in the art will appreciate that the coupling direction of RF energy is conditioned based the position of the apertures 34 formed on the main arm 4. In particular, if the apertures are mirrored in the waveguide arm relative to the waveguide axis, the coupling port of the SIW element 6 becomes the isolated port, and the isolated port becomes the coupled port. By providing an SIW element 6 having two pairs of apertures 36*a* 36*b*, a same SIW element 6 configuration can be used whether the apertures 34 formed on the main arm 4 are as shown in FIG. 8 or whether they are the positions of the apertures are mirrored in the waveguide arm relative to the waveguide axis.

The apertures 36 of the SIW element 6 may be made using any suitable technique. For instance, in this embodiment, the apertures 36 may be made via lithography. In an alternative implementation, the apertures 36 may be machined by milling. Any other suitable technique may be used in alternative implementations.

In an alternate embodiment (not shown in the figures), the bottom metallic layer 26 of the SIW element 6 may be omitted so that the SIW element 6 is comprised of the top metallic layer 24 and the dielectric substrate 22, wherein the dielectric substrate rests directly upon on the upper surface of the main arm 4. In such alternate embodiment, the RF energy between the main arm 4 and the SIW element 6 is coupled through the apertures 34 formed in the main arm 4.

As will be appreciated, the relatively small size (height) of the SIW element 6 compared to the main arm 4 allows a reduction in the overall dimensions of the cross-guide coupler 2. Thus the resulting compactness of the cross-guide coupler 2 may allow a more efficient use of space in waveguide networks as well as allow additional configurations of the waveguide network which might not be possible with conventional cross-guide couplers of the type referred to in the background section of the present document.

Figure 14:
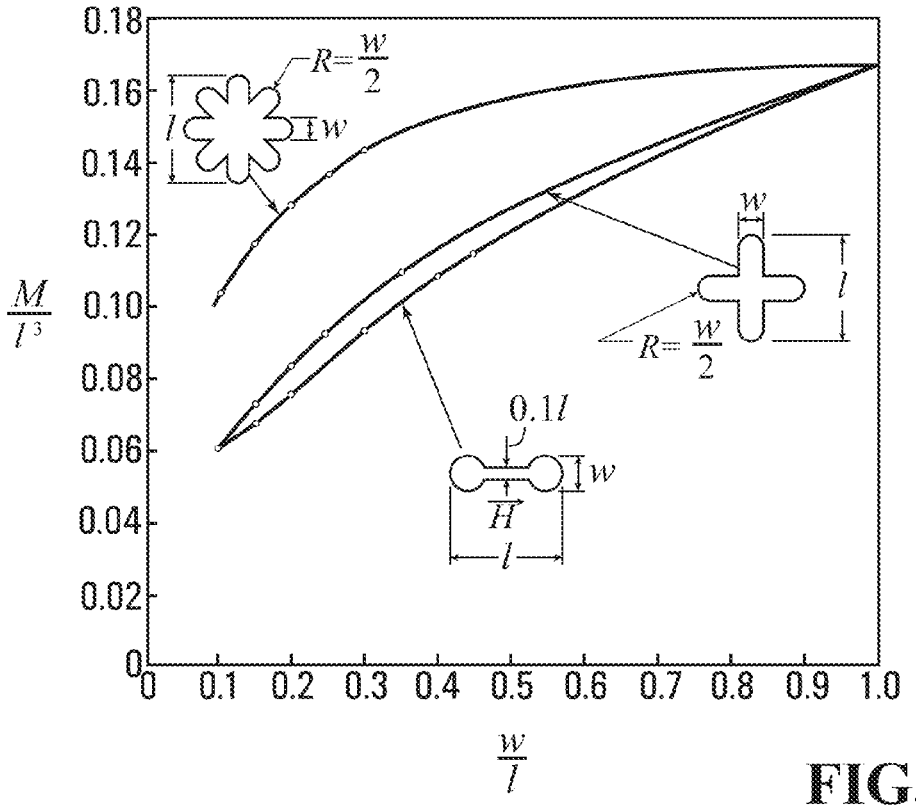
FIGS. 14 and 15 are graphs respectively showing a magnetic polarizability and an electric polarizability associated with different shapes of coupling apertures as a function of their dimensions.
Figure 15:
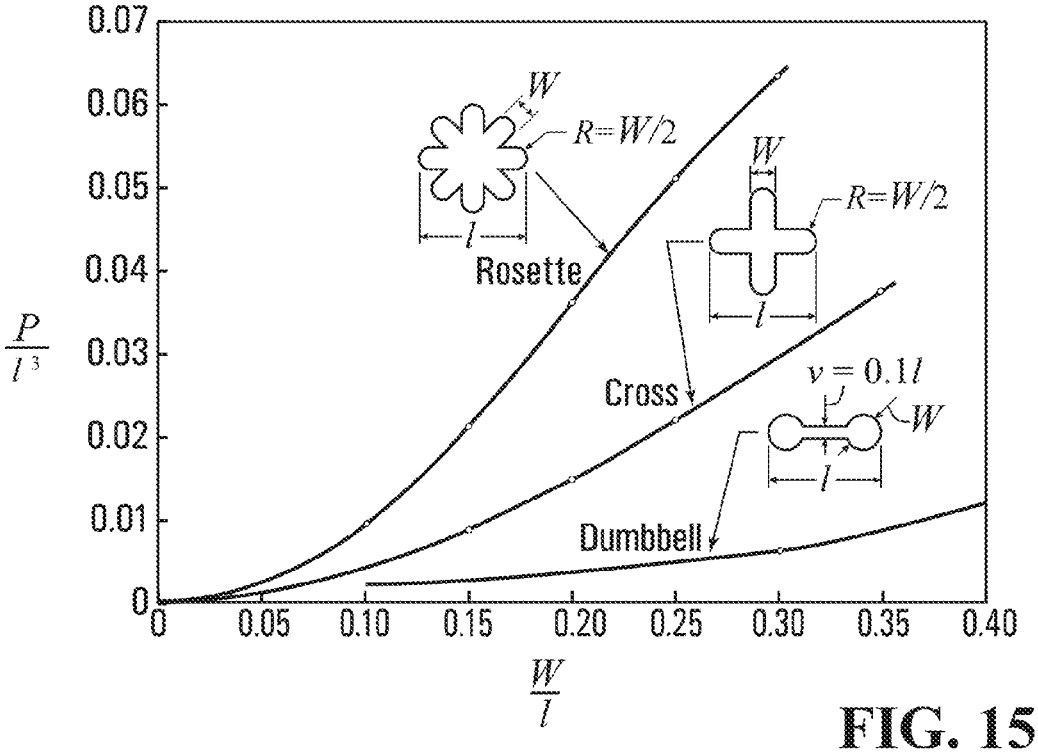

As mentioned briefly above, the apertures 34 in the main arm 4 have an associated magnetic polarizability $\alpha_m$ and electric polarizability $\alpha_e$. As shown in FIGS. 14 and 15, different types of apertures 34 may have different magnetic and electric polarizability values (denoted in FIGS. 14 and 15 as M and P respectively) in accordance to their shape and dimensions. For additional information, the reader is invited to refer to S. Cohn, "*Determination of aperture parameters by electrolytic-tank measurements*", Proc. IRE, vol. 39, pp. 1416-1421 (1951), from which FIGS. 14 and 15 were extracted and which is incorporated herein by reference.

The magnetic polarizability $\alpha_m$ associated with the apertures 34 affects a quality of the coupling of RF energy between the main arm 4 and the secondary arm 5. More specifically, a maximum value of a coupling factor C, which defines the quality of the coupling between the main arm 4 and the SIW element 6, is generally desirable for a given application. For a waveguide cross-guide coupler having a single cross-shaped aperture, the coupling factor C may be written as, $$C = -\frac{2\pi\alpha_m}{a^2 b}\sin\left(\frac{2\pi d}{a}\right)$$

where $\alpha_m$ is the magnetic polarizability associated with the aperture, a is the larger dimension of the main arm 202, h is the height of the main arm, and d is the distance from the cross-shaped aperture to the closest one of the lateral walls of the main arm.

FIG. 14 shows that a rosette-shaped aperture would have a greater magnetic polarizability compared to a cross-shaped or a dumbbell-shaped aperture. Thus, at first glance, it may seem advantageous for the main arm 4 to have a rosette-shaped aperture such as to maximize the coupling factor C. However, as shown in FIG. 15, the electric polarizability of a rosette-shaped aperture is also greater than that of a cross-shaped or dumbbell-shaped aperture. The electric polarizability, i.e., the amount of electric field coupling to the secondary arm of a cross-guide coupler via the coupling apertures, may be detrimental to the directivity of the cross-guide coupler. The directivity of the cross-guide coupler is the amount of power that is transmitted in one direction of the secondary arm minus the amount of power transmitted in the opposite direction of the secondary arm and can generally be expressed as, $$D = 20\log\frac{\alpha_m}{\alpha_e}$$

where the directivity D is given in dB. Therefore, it is generally desirable for the apertures 34 to have a greater magnetic polarizability $\alpha_m$ and at the same time a low electric polarizability $\alpha_e$. The inclusion of a pair (two) of apertures 34 in the main arm 4 of the cross-guide coupler 2, as shown in the embodiments described above with reference to FIGS. 5 to 13, instead of a single aperture has been found in certain practical implementations to enable an increase in the magnetic coupling between the main arm 4 and the secondary arm 5 while at the same time allowing a reduction of a width of the apertures to minimize their electric polarizability $\alpha_e$, in accordance with FIG. 15.

As will be explained in detail below, the position of the apertures 34 may also affect the amount of RF energy that may be coupled to the SIW element 6.

As can be appreciated from the equation above, the coupling factor C is maximum when $$\sin\left(\frac{2\pi d}{a}\right) = 1 \text{ (i.e., when } d = a/4).$$

Thus, in implementations in which there is a single cross-shaped aperture, the coupling factor C is maximum when the cross-shaped aperture is positioned such that it is spaced apart from a lateral wall of the main arm by a quarter of the width a of the main arm. This position of the cross-shaped aperture corresponds generally to a position of circular polarization of the magnetic field in the main arm, of the type illustrated in FIGS. 4A to 4D.

The coupling factor C associated with a waveguide coupler having a pair (two) of cross-shaped apertures in the main arm 4 of the cross-guide coupler 2, as shown in the embodiments described above with reference to FIGS. 5 to 13, can be written as, $$C = \frac{2\pi\alpha_m}{a^2 b}\sin\left(\frac{2\pi d}{a}\right)\sin[\beta(a-2d)]$$

where $\beta=2\pi/\lambda_g$ and $\lambda_g$ is the guided wavelength in the main arm. From this equation, it will be appreciated that the coupling factor C is maximum when $\sin[\beta(a-2d)]=1$ (i.e., when $a-2d=\lambda_g/4$). In other words, the RF signals transmitted from the two coupling apertures 34 formed in the main arm 4 of the cross-guide coupler 2 would add constructively when they propagate through the secondary arm 6 if the phase difference between the two RF signals is about a quarter wavelength.

Thus, in a specific practical implementation, the two cross-shaped apertures 34 of waveguide coupler 2 are positioned so that a distance between these apertures is about a quarter of a guided wavelength of the RF signal. This is depicted in FIG. 8 in which the cross-shaped apertures 34 are spaced apart from one another in the longitudinal direction of the main arm 4 by a distance $\lambda_g/4$. In addition, in a specific practical implementation, each cross-shaped aperture 34 may be spaced apart from an adjacent one of the lateral walls 12, 14 by a distance W/4 (i.e., a quarter of the width W of the main arm 4) measured between a center of the aperture 34 and a given one of the lateral walls 12, 14 of the main arm 4. Such a configuration has been found to result in a maximal coupling factor C of the RF signal between the main arm 4 and the SIW element 6.

For a rectangular waveguide operating in the $TE_{mn}$ mode, where m, n=0, 1, 2, . . . , the guided wavelength may be expressed as, $$\lambda_g = \frac{2\pi}{\sqrt{\omega^2\varepsilon\mu - \left(\frac{m\pi}{a}\right)^2 - \left(\frac{n\pi}{b}\right)^2}}$$

where $\omega=2\pi f$, f being the frequency of operation, and $\in$ and $\mu$ are the permittivity and permeability of the material inside the waveguide (see D. M. Pozar, "*Microwave Engineering*", Wiley, p. 113 (2000), which is incorporated herein by reference). For the fundamental mode of the waveguide, the $TE_{10}$ mode, the guided wavelength becomes, $$\lambda_g = \frac{2\pi}{\sqrt{\frac{\omega^2\varepsilon_r}{c^2} - \left(\frac{\pi}{a}\right)^2}}$$

where c is the speed of light.

As will be appreciated from the equation above, the guided wavelength $\lambda_g$ may be reduced by a factor inversely proportional to the square root of the permittivity of the material inside a waveguide.

The SIW element 6 of the cross-guide coupler 2 behaves similarly to a reduced-height waveguide with permittivity $\in_r$. Consequently, if the material inside the SIW element 6 has a larger permittivity, the distance between the apertures in each pair of cross-shaped apertures 36A and 38B in the direction of the secondary arm 6 will also be reduced by a factor inversely proportional to the square root of the permittivity of the dielectric material inside waveguide. Thus, in this case, the distance between the apertures 34 (and therefore also between the apertures 36) in the longitudinal direction of the SIW element 6 is reduced by a factor inversely proportional to the square root of the permittivity $\in_r$.

In specific practical implementations, the main arm 4 of the cross-guide coupler 2 and the cap (or cover) member 15 of the secondary arm 5 may be manufactured using any suitable manufacturing technique including molding, casting, or machining, among other possible manufacturing techniques. Generally speaking, in practical implementations, the main arm 4 of the cross-guide coupler 2 may be made in two separate portions; namely an upper portion $P_1$ and a lower portion $P_2$ (shown in FIG. 6), that may then be coupled together in order to form the complete main arm 4. The upper and lower portions $P_1$, $P_2$ can be coupled together via welding, bolts, rivets, or any other type of mechanical fastener known in the art. Alternatively, the upper and lower portions $P_1$, $P_2$ may be coupled together using a brazing process.

As for the SIW element 6 of the secondary arm 5, this component may be manufactured using any suitable process which may include material deposition method, followed by patterning (e.g., lithography) and/or etching and/or milling.

The Monitoring System 600

As will be appreciated from the above description, the first and second ports 18, 20 of the main arm 4 differ from the third and fourth ports 28, 30 of the SIW element 6 in that the first and second ports 18, 20 are waveguide ports that may be connected to other waveguide components (e.g., a circulator, a tuner, etc.) whereas the third and fourth ports 28, 30 are linked to connectors 25, 27 which may be used for connecting the cross-guide coupler 2 to an electronic monitoring device (for example). The electronic monitoring device may be configured to monitor the RF signal released at the third port 28 in order to obtain some information pertaining to the signals propagating through a waveguide arrangement to which the cross-guide coupler 2 is connected. Thus, provision of the third and fourth ports 28, 30 may be beneficial in that they allow connecting the cross-guide coupler 2 to the electronic monitoring device, without requiring adapter equipment to convert a signal propagating through a conventional (air-filled) waveguide into a signal that may be propagating through electronic circuitry.

Figure 16:
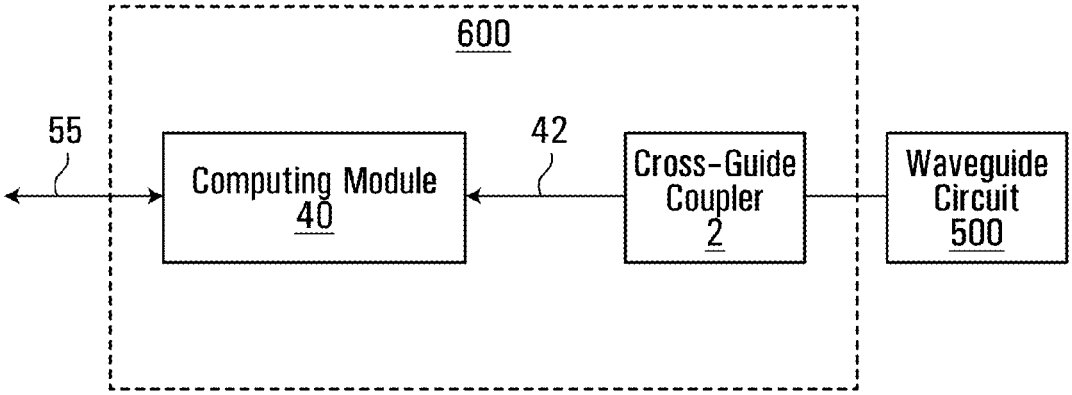
FIG. 16 is a block diagram of a monitoring system for a waveguide circuit comprising the cross-guide coupler depicted in FIG. 5 including a computing module in accordance with a non-limiting example of implementation.

FIG. 16 shows a monitoring system 600 comprised of the cross-guide coupler 2 and of a computing module 40 in communication with the cross-guide coupler 2 and programmed to monitor an output signal and, in some cases, may perform an action based on the output signal of the cross-guide coupler 2. This can allow the monitoring system 600 to monitor a performance of a waveguide circuit 500 of which the cross-guide coupler 2 is a part of. In this embodiment, the monitoring system 600 is comprised of the cross-guide coupler 2 and a computing module 40 connected to the cross-guide coupler 2 via a communication link 42. The communication link 42 may be implemented in various ways. For instance, in this embodiment, the communication link 42 is a wired connection (e.g., a USB connection). In other embodiments, the connection 42 may be a wireless communication link and may include, amongst other, a transmitter and receiver arrangement. For instance, in some cases, the communication link 42 may be a Bluetooth® communication link or any other suitable type of wireless connection.

The computing module 40 may be configured to receive and process a signal output by the cross-guide coupler 2 (via the secondary arm 5). More specifically, in this case, the output signal provided by the cross-guide coupler 2 is an electrical (sample) signal representative of the RF signal that is propagating through the main arm of the cross-guide coupler 2.

Figure 17:
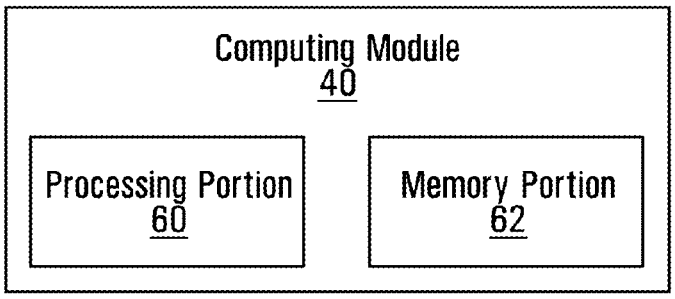
FIG. 17 is a block diagram of the computing module of the monitoring system of FIG. 16.

As shown in FIG. 17, the computing module 40 may comprise a processing portion 60 and a non-transient memory portion 62. The processing portion 60 comprises one or more processors for performing processing operations that implement functionality of the computing module 40. A processor of the processing portion 30 may be a general-purpose processor executing program code stored in the memory portion 62. Alternatively, a processor of the processing portion 60 may be a specific-purpose processor comprising one or more preprogrammed hardware or firmware elements (e.g., application-specific integrated circuits (ASICs), electrically erasable programmable read-only memories (EEPROMs), etc.) or other related elements.

The memory portion 62 comprises one or more memories for storing program code executable by the processing portion 60 and/or data used during operation of the processing portion 60. A memory of the memory portion 62 may be a semiconductor medium (including, e.g., a solid-state memory), a magnetic storage medium, an optical storage medium, and/or any other suitable type of memory. A memory of the memory portion 62 may be read-only memory (ROM) and/or random-access memory (RAM), for example.

In some embodiments, two or more elements of the computing module 40 may be implemented by devices that are physically distinct from one another and may be connected to one another via a bus (e.g., one or more electrical conductors or any other suitable bus) or via a communication link which may be wired, wireless, or both. In other embodiments, two or more elements of the computing module 40 may be implemented by a single integrated device.

In a specific implementation, the non-transient computer readable memory 62 may store computer executable code. The computer executable code, when executed by the processing portion 60, allows processing the output signal of the cross-guide coupler 2, for example to interpret the RF signal propagating in the cross-guide coupler 2. This may allow the computing module 40 to ascertain certain parameters of the RF signal such as, for example, its frequency, its amplitude, its wavelength, etc. . . . as well as to attempt to identify potential anomalies in the RF signal, which may indicate some type of defect. In some embodiments, the computing module 40 may be configured to record the parameters associated with the RF signal on a non-transient computer readable storage medium. For example, the computing module 40 may record multiple entries of the parameters associated with the RF signal on memory 62 in order to maintain a historical record of the parameters associated with the RF signal. This may be useful for analysis and troubleshooting purposes.

In some embodiments, the computing module 40 may be programmed to convey information relating to the RF signal of the cross-guide coupler 2 by displaying visual information. For example, the computing module 40 releases signals causes information relating to the RF signal of the cross-guide coupler 2 to be visually conveyed on a display unit (not shown) to which it is in communication with the computing module 40 and which is configured for displaying the information relating to the RF signal of the cross-guide coupler 2.

The computing module 40 may also be programmed to implementation some diagnostic functions. For example, the computing module 40 may be programmed to process the signal released by the cross-guide coupler 2 to detect in that signal a behavior, which may be conveyed by a measurements and or a pattern of measurements for example, that may indicate a problem or malfunction associated with the waveguide circuit in which the cross-guide coupler 2 is located. For example, the computing module 40 may have stored (e.g., in a memory) an "expected" RF signal pattern and/or measurement (for example voltages, frequencies, amplitudes, wavelengths and the like) that it may use as a reference to compare with the signal released by the cross-guide coupler 2. When the RF signal of the cross-guide coupler 2 deviates substantially from the expected RF signal pattern and/or measurement, the computing module 40 may be programmed to determine that there may be a problem with the waveguide circuit 500.

In a specific implementation, the computing module 40 may be programmed to monitor the voltage of the RF signal propagating through the waveguide circuit. In such an implementation, the measured RF signal released by the cross-guide coupler 2 is processed to convert it into a measured DC voltage. In a non-limiting implementation that conversion may be performed by a diode. The measured voltage would then be compared to a reference voltage, proportional to the amplitude of the RF signal. If the measured voltage is materially different from the reference voltage, this may be an indicator of a potential problem in the waveguide circuit 500. For example, if the measured voltage is much larger than the reference voltage, this may indicate that the amount of power returning to the signal source may be too high, which is an undesirable situation.

In some embodiments, detection of a problem associated with the RF signal of the cross-guide coupler 2 may trigger the computing module 40 to perform an action. For example, upon detecting a problem associated with the RF signal of the cross-guide coupler 2, the computing module 40 may display a notification message on the display unit to which it is connected. In some cases the notification message may be an audible notification message (e.g., an alarm). In some embodiments, the computing module 40 may send a notification to a user upon detecting a problem associated with the RF signal of the cross-guide coupler 2. In some cases, the notification may be a notification sent to an entity within the network to which the computing module 40 is connected. Such notifications may allow an operator to be made aware of malfunctions associated with the waveguide circuit 500 remotely.

The computing module 40 may also be connected to private and/or public computer networks (not shown) via a communication link 55, the computer network including one or more computing devices. For instance, the network may comprise computers and/or other communication devices, including portable computing devices such as for example smartphones, tablets and the like. The computing module 40 may be programmed for communicating information relating to the RF signal of the cross-guide coupler 2 to computing device in the network. In such a configuration, the computing module 40 may be programmed for issuing notifications to one or more devices in the network in order to convey some information pertaining to the RF signal of the cross-guide coupler 2.

Notifications may include alert messages (which may for example be in the form of e-mails, SMS, push notifications, pop-up windows on a computer display device or any other suitable type of message) conveying a potential malfunction of the waveguide circuit 500 to which the cross-guide couple is connected. The notifications may also convey different events that may be of interest to a user in monitoring the behavior of the waveguide circuit 500 and/or performing some diagnostics pertaining to the RF signal.

Optionally the computing module 40 may also be programmed for issuing control signals for deactivating at least some portions of the waveguide circuit 500 following detection of certain specific potential malfunctions to reduce the chance of damage being caused by the potential malfunction. In a non-limiting example, the control signals issued by the computing module 50 following detection of certain specific potential malfunctions may be configured to deactivate a power source driving the RF signals propagating through the waveguide circuit 500.

The foregoing is considered as illustrative only of the principles of the invention. Since numerous modifications and changes will become readily apparent to those skilled in the art in light of the present description, it is not desired to limit the invention to the exact examples and embodiments shown and described, and accordingly, suitable modifications and equivalents may be resorted to. It will be understood by those of skill in the art that throughout the present specification, the term "a" used before a term encompasses embodiments containing one or more to what the term refers. It will also be understood by those of skill in the art that throughout the present specification, the term "comprising", which is synonymous with "including," "containing," or "characterized by," is inclusive or open-ended and does not exclude additional, un-recited elements or method steps.

Unless otherwise defined, all technical and scientific terms used herein have the same meaning as commonly understood by one of ordinary skill in the art to which this invention pertains. In the case of conflict, the present document, including definitions will control.

Although the present invention has been described in considerable detail with reference to certain embodiments thereof, variations and refinements are possible.

For example, it is to be appreciated that, while the cross-guide coupler 2 has been depicted as a standalone component, which may be in turn connection to other devices, in alternative implementations, the cross-guide coupler 2 may be integrated and form part of a multi-component waveguide assembly, for example a multi-component waveguide assembly of the type described in U.S. Pat. No. 8,324,990 issued on Dec. 4, 2012. The contents of the aforementioned document are incorporated herein by reference.

Many other variations will become apparent to persons skilled in the art in light of the present description. The invention is defined more particularly by the attached claims.

The invention claimed is:

1. A cross-guide coupler for use in a waveguide network, said cross-guide coupler comprising:

a main waveguide arm comprising an input port and a transmitted port, said main waveguide arm including a hollow metallic conduit;

a secondary arm positioned substantially transversely relative to the main arm and being fastened to the main arm;

wherein the secondary arm includes a substrate integrated waveguide and a cover member shielding the substrate integrated waveguide.

2. A cross-guide coupler as defined in claim 1, wherein the hollow metallic conduit has a generally rectangular cross-section defined by a top wall, a bottom wall, and opposite lateral walls.

3. A cross-guide coupler as defined in claim 2, wherein said secondary arm is fastened to the main arm along at least a portion of an outer surface of said top wall, and wherein said main arm includes a coupling aperture formed on said top wall for coupling at least part of energy travelling through said main waveguide arm into said secondary arm.

4. A cross-guide coupler as defined in claim 3, wherein said coupling aperture is cross-shaped.

5. A cross-guide coupler as defined in claim 3, wherein the substrate integrated waveguide includes a dielectric substrate and top and bottom metallic layers between which the dielectric substrate is sandwiched.

6. A cross-guide coupler as defined in claim 5, wherein an aperture is formed on the bottom metallic layer of the substrate integrated waveguide, wherein the aperture formed on the bottom metallic layer is positioned so as to be substantially aligned with the coupling aperture formed on said top wall of said main waveguide arm.

7. A cross-guide coupler as defined in claim 6, wherein said aperture formed on the bottom metallic layer of the substrate integrated waveguide is cross-shaped.

8. A cross-guide coupler as defined in claim 3, wherein said main arm includes a pair of coupling apertures formed on said top wall.

9. A cross-guide coupler as defined in claim 8, wherein coupling apertures of the pair of coupling apertures are spaced-apart by a distance that is about a quarter of a wavelength.

10. A cross-guide coupler as defined in claim 8, wherein each coupling aperture is said pair of coupling apertures is cross-shaped.

11. A cross-guide coupler as defined in claim 8, wherein the substrate integrated waveguide includes a dielectric substrate and top and bottom metallic layers between which the dielectric substrate is sandwiched and wherein a pair of apertures is formed on the bottom metallic layer of the substrate integrated waveguide, the pair of apertures being positioned so as to be substantially aligned with the pair of coupling apertures formed on said top wall of said main waveguide arm.

12. A cross-guide coupler as defined in claim 11, wherein the pair of apertures formed on the bottom metallic layer of the substrate integrated waveguide is a first pair of apertures, said substrate integrated waveguide including a second pair of apertures formed on the bottom metallic layer of the substrate integrated waveguide.

13. A cross-guide coupler as defined in claim 3, wherein the substrate integrated waveguide includes a dielectric substrate and a top metallic layer positioned over the dielectric substrate, wherein the dielectric substrate is sandwiched between the top metallic layer and the outer surface of the top wall of the main arm.

14. A cross-guide coupler as defined in claim 1, wherein a plurality of via holes are formed within the substrate integrated waveguide, said plurality of via holes being arranged in two rows spaced apart laterally along sides of the substrate integrated waveguide.

15. A cross-guide coupler as defined in claim 1, wherein a pair of elongated channels are formed within the substrate integrated waveguide, channels of said pair of elongated channels being spaced apart laterally along sides of the substrate integrated waveguide.

16. A cross-guide coupler as defined in claim 1, wherein the cover member of the secondary arm includes one or more contact elements adapted to capture a signal travelling through the substrate integrated waveguide, the one or more contact element being configured for establishing an electrical connection between the substrate integrated waveguide and an external computing device.

17. A cross-guide coupler as defined in claim 1, wherein the external computing device includes an electronic monitoring device.

18. A waveguide circuit having monitoring capabilities, said waveguide circuit comprising:

a cross-guide coupler comprising:

i. a main waveguide arm comprising an input port and a transmitted port, said main waveguide arm including a hollow metallic conduit;

ii. a secondary arm positioned substantially transversely relative to the main arm and being fastened to the main arm;

wherein the secondary arm includes a substrate integrated waveguide;

waveguide circuit components coupled to the main waveguide arm of the cross-guide coupler;

an electronic monitoring device connected to the secondary arm for receiving an electrical signal representative of an RF signal propagating through the main waveguide arm of the cross-guide coupler.

19. A waveguide circuit as defined in claim 18, wherein the waveguide circuit components coupled to the main waveguide arm of the cross-guide coupler include at least one of a circulator, a tuner and a filter.

20. A waveguide circuit as defined in claim 18, wherein said electronic monitoring device is programmed for processing the electrical signal to derive characteristics of the RF signal propagating through the main waveguide arm of the cross-guide coupler.

21. A waveguide circuit as defined in claim 20, wherein the derived characteristics of the RF signal include at least one of a frequency, amplitude and wavelength.

22. A waveguide circuit as defined in claim 20, wherein the electronic monitoring device is programmed for storing the derived characteristics of the RF signal on a non-transient computer readable storage medium.

23. A waveguide circuit as defined in claim 20, wherein the electronic monitoring device is programmed for visually conveying the derived characteristics of the RF signal on a display in communication with the electronic monitoring device.

24. A waveguide circuit as defined in claim 20, wherein said electronic monitoring device is programmed for detecting a potential malfunction associated with the waveguide circuit components coupled to the main waveguide arm at least in part by processing the derived characteristics of the RF signal propagating through the main waveguide arm of the cross-guide coupler.

25. A waveguide circuit as defined in claim 24, wherein said electronic monitoring device is programmed for issuing a notification message following detection of the potential malfunction associated with the waveguide circuit components coupled to the main waveguide arm.

26. A waveguide circuit as defined in claim 24, wherein issuing the notification message includes one or sending an e-mail message, sending an SMS message and displaying a pop-up window on a computer display device.

27. A waveguide circuit as defined in claim 24, wherein said electronic monitoring device is programmed for issuing control signal for deactivating at least some portions the waveguide circuit following detection of the potential malfunction.

28. A waveguide circuit as defined in claim 18, wherein the secondary arm of the cross-guide coupler includes the substrate integrated waveguide and a cover member shielding the substrate integrated waveguide.

29. A waveguide circuit as defined in claim 18, wherein the cover member of the secondary arm includes one or more contact elements adapted to capture a signal travelling through the substrate integrated waveguide, the one or more contact element being configured for establishing an electrical connection between the substrate integrated waveguide and the electronic monitoring device.

30. A cross-guide coupler for use in a waveguide network, said cross-guide coupler comprising:

a main waveguide arm comprising an input port and a transmitted port, said main waveguide arm including a hollow metallic conduit having a generally rectangular cross-section defined by a top wall, a bottom wall, and opposite lateral walls, wherein a coupling aperture is formed on said top wall;

a secondary arm including a substrate integrated waveguide and being positioned substantially transversely relative to the main arm, said secondary arm being fastened to the main arm along at least a portion of an outer surface of said top wall, the substrate integrated waveguide including a dielectric substrate and top and bottom metallic layers between which the dielectric substrate is sandwiched, a cross-shaped aperture being formed on the bottom metallic layer of the substrate integrated waveguide, said cross-shaped aperture being positioned so as to be substantially aligned with the coupling aperture formed on said top wall of said main waveguide arm for coupling at least part of energy travelling through said main waveguide arm into said secondary arm.

31. A cross-guide coupler as defined in claim 30, wherein the secondary arm of the cross-guide coupler includes the substrate integrated waveguide and a cover member shielding the substrate integrated waveguide.

32. A cross-guide coupler as defined in claim 31, wherein the cover member of the secondary arm includes one or more contact elements adapted to capture a signal travelling through the substrate integrated waveguide, the one or more contact element being configured for establishing an electrical connection between the substrate integrated waveguide and an electronic monitoring device.

33. A cross-guide coupler for use in a waveguide network, said cross-guide coupler comprising:

a main waveguide arm comprising an input port and a transmitted port, said main waveguide arm including a hollow metallic conduit having a generally rectangular cross-section defined by a top wall, a bottom wall, and opposite lateral walls, wherein a pair of coupling apertures is formed on said top wall;

a secondary arm including a substrate integrated waveguide and being positioned substantially transversely relative to the main arm, said secondary arm being fastened to the main arm along at least a portion of an outer surface of said top wall, the substrate integrated waveguide including a dielectric substrate and top and bottom metallic layers between which the dielectric substrate is sandwiched, a first pair of apertures and a second pair of apertures being formed on the bottom metallic layer of the substrate integrated waveguide, said first pair of apertures being positioned so as to be substantially aligned with the pair of coupling apertures formed on said top wall of said main waveguide arm for coupling at least part of energy travelling through said main waveguide arm into said secondary arm.

34. A cross-guide coupler as defined in claim 33, wherein the secondary arm of the cross-guide coupler includes the substrate integrated waveguide and a cover member shielding the substrate integrated waveguide.

35. A cross-guide coupler as defined in claim 34, wherein the cover member of the secondary arm includes one or more contact elements adapted to capture a signal travelling through the substrate integrated waveguide, the one or more contact element being configured for establishing an electrical connection between the substrate integrated waveguide and an electronic monitoring device.

* * * * *